US005419159A

United States Patent [19]

Muller

[11] Patent Number: 5,419,159

[45] Date of Patent: May 30, 1995

[54] ARTICLE OF JEWELRY

[76] Inventor: Ludwig Muller, Les Telleuls, 1298 Celigny, Switzerland

[21] Appl. No.: 103,167

[22] Filed: Aug. 6, 1993

Related U.S. Application Data

[63] Continuation of Ser. No. 922,178, Jul. 30, 1992, abandoned.

[30] Foreign Application Priority Data

Aug. 6, 1991 [CH] Switzerland ..... 02324/91

[51] Int. Cl.[6] ..... A44C 17/02

[52] U.S. Cl. ..... 63/28; 63/32

[58] Field of Search ..... 63/9, 26, 28, 31, 32

[56] References Cited

U.S. PATENT DOCUMENTS

| | | | |
|---|---|---|---|
| 1,441,597 | 1/1923 | Pejchar | 63/9 |
| 5,072,601 | 12/1991 | Slowinski | 63/28 |
| 5,115,649 | 5/1992 | Amber | 63/26 |

FOREIGN PATENT DOCUMENTS

| | | | |
|---|---|---|---|
| 2530432 | 1/1984 | European Pat. Off. . | |
| 2574638 | 6/1986 | European Pat. Off. . | |
| 346210 | 1/1905 | France . | |
| 802367 | 9/1936 | France | 63/28 |
| 826559 | 4/1938 | France | 63/28 |
| 833234 | 10/1938 | France | 63/28 |
| 835817 | 1/1939 | France | 63/28 |
| 432074 | 7/1935 | United Kingdom | 63/28 |
| 513052 | 12/1937 | United Kingdom | 63/28 |

*Primary Examiner*—Michael J. Milano
*Attorney, Agent, or Firm*—Ostrolenk, Faber, Gerb & Soffen

[57] ABSTRACT

An article of jewelry having a stone mounted on a support. The stone having two grooves formed in opposite side facets which are engaged by two facing surfaces of the support to secure the stone in the support. In one embodiment, the support includes an array of bars, each bar having a central cavity and two side walls. Each side wall has a surface for engaging a corresponding groove in the stone and an attachment for articulated connection of each bar to the adjacent bars.

9 Claims, 1 Drawing Sheet

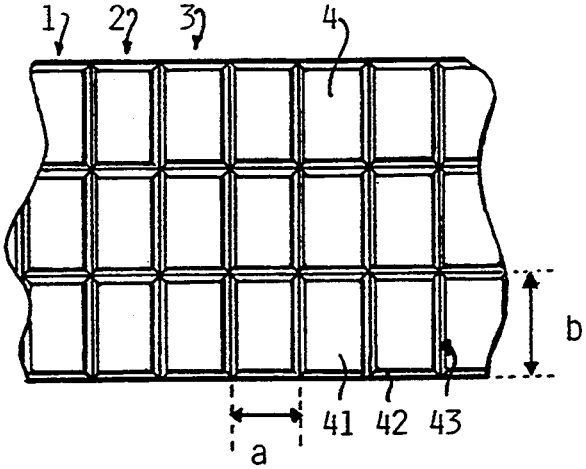
Fig. 1
Fig. 2
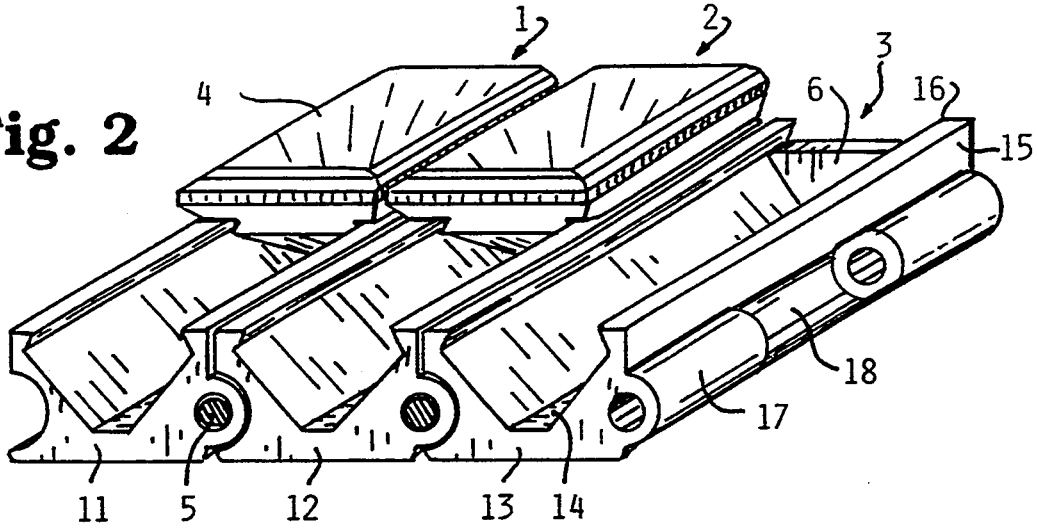
Fig. 3
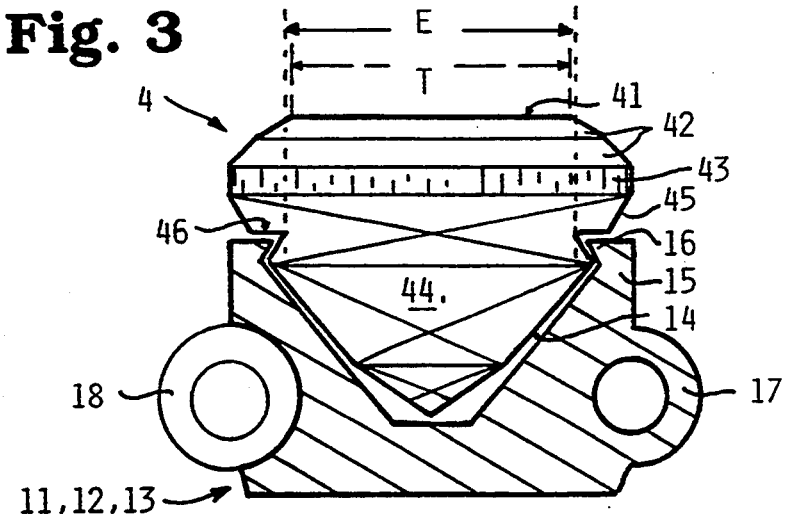
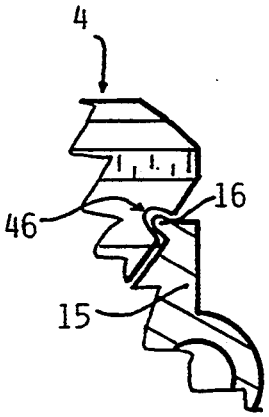
Fig. 4

ARTICLE OF JEWELRY

This is a continuation of application Ser. No. 07/922,178, filed Jul. 30, 1992, now abandoned.

BACKGROUND OF THE INVENTION

The present invention relates to an article of jewelry. More particularly, the invention relates to mounting stones on a support to make an article of jewelry.

For many years, precious and non-precious stones have been mounted by crimping between the prongs of a support, generally of metal. The frame forming the setting, as well as the prongs of the support, remains visible when the jewel is viewed from above.

This manner of mounting is suitable for stones of large size, which are generally mounted by themselves. On the other hand, when it is desired to obtain a relatively large surface by placing smaller stones together, the visible metal parts create interruptions in the continuity of the surface. Furthermore, it is difficult to obtain a non-planar surface.

SUMMARY OF THE INVENTION

The present invention is directed to overcoming these drawbacks, and its object is an article of jewelry comprising at least one mounted stone.

This article of jewelry includes a support comprising at least two facing surfaces adapted to cooperate with corresponding grooves in opposite sides of the stone.

In a preferred embodiment, said support is formed by a series of bars, each bar having means for attachment to a neighboring bar. The attachment means permits pivoting of each bar with respect to the adjacent one.

Each bar is preferably formed of a rail having a central recess. The central recess is open towards the top. The recess is defined by side wings each of which is provided in its upper part with an inner surface and in its outer part with the means for fastening the bar to an adjacent bar. A closure tip is fastened to the ends of the rail so as to close the ends of the central recess and hold the stone in place.

Other features and advantages of the present invention will become apparent from the following description of the invention which refers to the accompanying drawings.

BRIEF DESCRIPTION OF THE DRAWINGS

FIG. 1 is a top view of an assembly of stones according to the invention;

FIG. 2 is a partial view in perspective of a support in accordance with the invention;

FIG. 3 is a cross section on a larger scale through one of the bars of FIG. 2; and FIG. 4 is a partial cross section view of a stone on a bar;

DETAILED DESCRIPTION OF THE INVENTION

FIG. 1 shows a top view of an article of jewelry, such as a bracelet, having rows 1, 2, 3, etc. of three stones each of width a and length b. In FIG. 1, each stone 4 has a table facet 41 and a bevel 42 forming the connection between the table facet 41 and a girdle 43 of generally rectangular shape. It will be noted that no metal support is visible in this top view, since the girdles of the faces of adjacent stones touch each other as will be seen in further detail below.

FIG. 2 shows bars 11 to 13, corresponding to the rows 1 to 3 shown in FIG. 1, each of these bars being dimensioned to receive stones along its length. Each of the bars 11 to 13 has a central recess 14 of general V-shape which is open towards the top. The recess 14 is closed by two side wings 15, each having in their upper part a surface 16 directed towards the inside of the bar. In order to ensure articulation of each of the bars 11 to 13 with respect to the neighboring bars, the wings 15 have been provided on the outside with a series of lugs 17. Hollows 18 of corresponding shape are also provided to fit together with the lugs 17 and they receive a common pin 5. The common pin 5 connects two adjacent bars side by side while assuring relative bending between them.

The bars shown in the drawing are linear but, without going beyond the scope of the invention, they could be imparted a certain curvature.

At the two ends of the recess 14, there are provided closure plates 6 intended to hold the stones 4 in position, as will be seen further below.

In FIG. 3, one of the bars 11 to 13 is shown in section, and a stone 4 is shown in end view. Also shown are lug 17 and the corresponding hollow 18, as well as the two facing surfaces 16 bordering the recess 14.

The stone 4 has a table facet 41 as well as two bevel facets 42 that are inclined downward and reach the outside dimensions of the girdle 43. The culet 44 of the stone has, in a traditional manner, side facets which are cut with angles intended to reflect light rays. In each of two of the side facets 45, extending parallel to each other and below the girdle 43, a respective one of two parallel notches 46 are made. These notches 46 are dimensioned so as to permit the holding of the stone 4 once the latter has been slid in from the end of the bar 11. As seen in FIG. 3, when the stone is installed in the bars 11–13, the culet 44 is located parallel to and at a distance from the side walls of the recess 14 of the bars 11–13.

It is obvious that the grooves 46 are cut to have a shape substantially similar to the shape of the inner faces 16 of the bars 11–13. FIG. 3 shows grooves 46 formed by two flat surfaces arranged as a V, while in FIG. 4 the grooves 46 have rounded shapes.

As shown in FIG. 3, the minimum distance E between the bottom of the grooves 46 made on both sides of the stone remains greater than the dimension T of the table facet 41 so that the grooves 46 are not visible from above. Instead, the bottoms of those grooves are under the bevel facets 42 where they are less visible.

To assemble the stones in accordance with the invention, one or more stones are slid into one or more bars in such a manner that the girdles of adjacent stones practically touch each other. Referring to FIG. 2, a second closure element 6 is then placed at the front of the bars by means known to persons skilled in the art.

Due to this type of mounting, the bars forming the support are not visible and the stones shine with their entire brightness. Such mounting can be used with synthetic stones, fine stones or precious stones.

A stone of generally rectangular shape has been shown in the drawing. However, the invention is not limited to rectangular or square stones or to baguettes. The mounting described above also makes it possible to mount stones of marquise, pear or other shapes.

As another embodiment, a removable attachment can be provided at the end of the bar, making it possible to change the arrangement of stones of different color.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An article of jewelry comprising:

a) a stone including:

1) a top portion;

2) a bottom portion;

3) at least two side portions connecting the top portion and bottom portion, each of the two side portions having a groove formed therein; and b) a support for mounting the stone, the support including:

1) two surfaces each facing one of the two side portions of the stone and each of the two surfaces fitting within the groove in a respective facing side portion of the stone to secure the stone in the support;

2) a cavity for receiving the bottom portion of the stone, the cavity having a bottom portion and two opposed side walls, each of the side walls facing a respective side portion of the stone, each of the side walls being substantially parallel to an adjacent side portion of the stone from a respective surface of the support to the bottom portion of the cavity;

3) a plurality of bars, the plurality of bars being located next to each other, each bar having at least one stone mounted therein and including means for attaching the bar to an adjacent bar.

2. An article of jewelry according to claim 1, wherein the top portion has a pair of opposite edges and each groove has a bottom surface which is located so that each of the pair of opposite edges of the top portion extend beyond a respective groove.

3. An article of jewelry according to claim 2, wherein the top portion has a table facet located thereon and the grooves are formed on opposite sides of the stone so that a distance between the bottom surfaces of the grooves is greater than a width of the table facet so that the grooves are not visible when the article of jewelry is viewed from the top portion of the stone.

4. An article of jewelry according to claim 3, further comprising a plurality of bevel facets located between the table facet and the side portions, wherein the bottom surfaces of the grooves are located beneath the bevel facets.

5. An article of jewelry according to claim 1, wherein each bar comprises a rail, the rail including the cavity for mounting at least one stone, the cavity extending along the length of the rail, each of the two opposed side walls of the cavity having an upper end and a lower end, each of the surfaces of the support being located on an inner surface of the upper end of each side wall, and the attachment means being located on an outer surface of the lower end of each side wall.

6. An article of jewelry according to claim 1, the support further comprising articulated fastening means engaging the attachment means of each bar for articulated connection of adjacent bars.

7. An article of jewelry according to claim 5, further comprising at least two closure tips adapted for engaging the rail at opposite ends to close the cavity to secure the stone in the support.

8. An article of jewelry comprising:

a stone having a table facet on top and a culet at the bottom, facets on the sides of the stone between the table facet and the culet; the stone having a respective groove formed in the side facets, the grooves opening outwardly from the stone; and a support for mounting the stone, the support having two surfaces each facing the other and one of the side facets and each surface engaging the groove in the respective facing facet of the stone to secure the stone in the support, the grooves having bottoms which are located so that a pair of opposite edges of the table facet are located above the respective grooves; the support comprising a plurality of bars, the plurality of bars being arrayed next to each other, each bar having at least one of the stones mounted on it and including means for attachment of each bar to the adjacent bars, each bar comprising a rail, the rail having a central cavity for mounting at least one stone, the cavity extending along the length of the rail and being open on top, the cavity being defined by two side walls, the walls being spaced apart and opposed to each other and each having an upper end and a lower end, one of the respective surfaces being located on an inner surface of the upper end of each side wall, and the attachment means being located on an outer surface of the lower end of each side wall; and at least two closure tips adapted for engaging the rail at opposite ends to close the central cavity to secure the stone in the support.

9. An article of jewelry comprising:

a) a stone including:

1) a top portion;

2) a bottom portion;

3) at least two side portions connecting the top portion and the bottom portion, each of the two side portions having a groove formed therein;

4) a table facet located on the top portion of the stone;

5) a culet located at the bottom portion of the stone; and 6) a plurality of facets located on the two side portions of the stone between the table facet and the culet;

b) a support for mounting the stone, the support including:

1) a plurality of bars arranged adjacent to each other, each of the bars having two surfaces which each face one of the two side portions, each of the two surfaces being received in the groove in a respective facing side portion of the stone to secure the stone in the support, each of the bars further having a cavity for receiving the culet of the stone, the cavity having a bottom surface and opposed side walls, the opposed side walls being disposed to face the two side portions of the stone, each of the side walls being substantially parallel to adjacent facets on a respective side portion of the stone from a respective surface of the bar to the bottom portion of the cavity; and 2) means for movably attaching each bar to the adjacent bars.

* * * * *